US009922758B2

(12) United States Patent
Urushihara et al.

(10) Patent No.: US 9,922,758 B2
(45) Date of Patent: Mar. 20, 2018

(54) POWDER FOR POWDER MAGNETIC CORE, AND POWDER MAGNETIC CORE

(71) Applicant: Kobe Steel, Ltd., Kobe-shi (JP)

(72) Inventors: Wataru Urushihara, Kobe (JP); Mikako Takeda, Kobe (JP); Mamoru Hosokawa, Kobe (JP); Hirofumi Hojo, Takasago (JP); Tomotsuna Kamijo, Takasago (JP)

(73) Assignee: Kobe Steel, Ltd., Kobe-shi (JP)

( * ) Notice: Subject to any disclaimer, the term of this patent is extended or adjusted under 35 U.S.C. 154(b) by 615 days.

(21) Appl. No.: 14/406,288

(22) PCT Filed: Jul. 9, 2013

(86) PCT No.: PCT/JP2013/068784
§ 371 (c)(1),
(2) Date: Dec. 8, 2014

(87) PCT Pub. No.: WO2014/013914
PCT Pub. Date: Jan. 23, 2014

(65) Prior Publication Data

US 2015/0228387 A1 Aug. 13, 2015

(30) Foreign Application Priority Data

Jul. 20, 2012 (JP) ..... 2012-162110

(51) Int. Cl.
*H01F 1/24* (2006.01)
*B22F 1/02* (2006.01)
(Continued)

(52) U.S. Cl.
CPC ..... *H01F 1/24* (2013.01); *B22F 1/0062* (2013.01); *B22F 1/02* (2013.01); *C23C 22/07* (2013.01);
(Continued)

(58) Field of Classification Search
CPC ..... H01F 3/08; H01F 1/24; B22F 1/02
(Continued)

(56) References Cited

U.S. PATENT DOCUMENTS

2010/0051851 A1 3/2010 Mitani et al.
2014/0183402 A1 7/2014 Hosokawa et al.

FOREIGN PATENT DOCUMENTS

CN 103608138 A 2/2014
JP 2710152 2/1998
(Continued)

OTHER PUBLICATIONS

International Search Report and Written Opinion of the International Searching Authority dated Oct. 15, 2013, in PCT/JP131068784 filed Jul. 9, 2013.
(Continued)

*Primary Examiner* — Weiping Zhu
(74) *Attorney, Agent, or Firm* — Oblon, McClelland, Maier & Neustadt, L.L.P.

(57) ABSTRACT

A powder for a powder magnetic core, being composed of iron-base soft magnetic powder particles which each have a phosphoric acid-based chemical conversion coating on the surface. In this powder, the maximum thickness of the phosphoric acid-based chemical conversion coating is 20 to 200 nm, and recessed portions are formed on the surface of the chemical conversion coating with the total area of openings of the recessed portions being 0.5 to 50% by area relative to the total area of the observation visual fields, as determined by observing ten or more parts of the surface of the phosphoric acid-based chemical conversion coating through a scanning electron microscope with a magnification of 10000× or more.

14 Claims, 2 Drawing Sheets

$(La+Lb+Lc-L0)/(La+Lb+Lc)\times 100 \geq 50\%$

(51) Int. Cl.

| | |
|---|---|
| ***H01F 1/26*** | (2006.01) |
| ***H01F 41/02*** | (2006.01) |
| ***H01F 3/08*** | (2006.01) |
| ***C23C 22/07*** | (2006.01) |
| ***H01F 1/147*** | (2006.01) |
| ***H01F 1/20*** | (2006.01) |
| ***C23C 22/08*** | (2006.01) |
| ***C23C 22/23*** | (2006.01) |
| ***B22F 1/00*** | (2006.01) |
| *B22F 3/02* | (2006.01) |

(52) U.S. Cl.
CPC ..... *C23C 22/08* (2013.01); *C23C 22/23* (2013.01); *H01F 1/147* (2013.01); *H01F 1/20* (2013.01); *H01F 1/26* (2013.01); *H01F 3/08* (2013.01); *H01F 41/0246* (2013.01); *B22F 3/02* (2013.01); *C22C 2202/02* (2013.01)

(58) Field of Classification Search
USPC ..... 75/232
See application file for complete search history.

(56) References Cited

FOREIGN PATENT DOCUMENTS

| | | | | |
|---|---|---|---|---|
| JP | 2710152 | B2 | | 2/1998 |
| JP | 4044591 | | | 2/2008 |
| JP | 2008-113138 | | | 5/2008 |
| JP | 2012-84803 | | | 4/2012 |
| JP | 2012084803 | A | * | 4/2012 |
| WO | 2012-173239 | | | 12/2012 |

OTHER PUBLICATIONS

Toru Maeda, et al., "Development of Low-iron-loss Sintered Magnetic Material", SEI Technical Review, vol. 166, Mar. 2005,6 pages (with partial English translation).

* cited by examiner $$(La+Lb+Lc-L0)/(La+Lb+Lc)\times 100 \geq 50\%$$

POWDER FOR POWDER MAGNETIC CORE, AND POWDER MAGNETIC CORE

TECHNICAL FIELD

The present invention relates to a powder for a powder magnetic core in which an insulation coating having high heat resistance is laminated on the surface of a soft magnetic powder such as an iron powder and an iron-based alloy powder (both are hereinafter collectively referred to simply as an iron powder) and a powder magnetic core obtained by compressively forming this powder for a powder magnetic core. The powder magnetic core of the present invention is used particularly for a magnetic core of electromagnetic parts.

BACKGROUND ART

For the core material of a motor, in the past, those obtained by laminating the flat rolled magnetic steel sheets, electrical steel sheets and the like were used, however, in recent years, the powder magnetic core has come to be utilized. Because the powder magnetic core is manufactured by compressively forming the powder for a powder magnetic core, the degree of freedom of the shape is high, a core of a three-dimensional shape can be easily manufactured, and therefore reduction of the size and reduction of the weight of the motor is easier compared to the motors of prior arts.

With respect to the powder magnetic core used for the electromagnetic parts, it is important to be excellent in handling performance in the manufacturing step, and to have sufficient mechanical strength so as not to be broken in winding for forming a coil. Considering these points, a technology for coating the iron powder with an electrical insulating material in manufacturing the powder magnetic core is known. More specifically, because the iron powder is coated with the electrical insulating material, the iron powder particles are adhered to each other through the electrical insulating material, and therefore the mechanical strength of the powder magnetic core obtained using the iron powder coated with the electrical insulating material improves more than that of the powder magnetic core manufactured using the iron powder as it is without coating.

With respect to the technology for increasing the mechanical strength of the powder magnetic core, Patent Literatures 1 and 2 are known. Out of these technologies, in Patent Literature 1, a technology is disclosed in which the mechanical strength of the powder magnetic core is increased by coating the surface of the soft magnetic powder particles with a glass-like insulating layer obtained from phosphoric acid and the like and further coating the same with a resin layer formed of an epoxy resin, imide resin, or fluorine contained resin. Also, in Patent Literature 2, it is described that, when the powder for a powder magnetic core in which a phosphoric acid-based chemical conversion coating and a silicone resin coating containing predetermined elements are formed in this order on the surface of the iron-based soft magnetic powder particle is used, a powder magnetic core satisfying such properties of high magnetic flux density, low iron loss, and high mechanical strength is obtained.

CITATION LIST

Patent Literature

[Patent Literature 1] Japanese Patent No. 2,710,152
[Patent Literature] Japanese Patent No. 4,044,591

SUMMARY OF INVENTION

Technical Problem

In the meantime, in order to improve the magnetic flux density of a powder magnetic core, to increase the density of the powder magnetic core is effective, and it is recommendable to reduce the amount of the electrical insulating material that coats the iron powder. On the other hand, in order to reduce the iron loss of the powder magnetic core particularly the hysteresis loss, it is effective to subject a powder compact to heat treatment at a high temperature, and to release the strain introduced in manufacturing the powder compact. Therefore, in order to reduce the hysteresis loss of the powder magnetic core, it is necessary not to deteriorate the insulation performance of the electrical insulating material that coats the iron powder even when a heat treatment at a high temperature (500-700° C. for example) is performed, and, in order to secure the insulation performance, it is effective to increase the amount of the electrical insulating material that coats the iron powder. Also, when the amount of the electrical insulating material is increased, the adhesive property between iron powder particles improves which contributes also to improvement of the mechanical strength of the powder magnetic core. However, when the amount of the electrical insulating material is increased, the density of the powder magnetic core drops, and the magnetic flux density of the powder magnetic core reduces. Therefore, when the amount of the electrical insulating material that coats the iron powder is watched, to improve the magnetic flux density of the powder magnetic core and to reduce the iron loss (particularly the hysteresis loss) of the powder magnetic core plus to improve the mechanical strength of the powder magnetic core are conflicting objects.

The present invention has been developed in view of such circumstances, and its object is to provide a powder for a powder magnetic core that has a phosphoric acid-based chemical conversion coating on the surface of the iron-based soft magnetic powder particle, effectively insulates between the iron-based soft magnetic powder particles, maintains excellent insulation performance even when a heat treatment is performed at a high temperature, and can increase the mechanical strength of the powder magnetic core. Also, another object of the present invention is to provide a powder magnetic core having excellent insulation performance and high mechanical strength.

Solution to Problems

The powder for a powder magnetic core related to the present invention which could solve the problems described above is a powder for a powder magnetic core composed of an iron-based soft magnetic powder having a phosphoric acid-based chemical conversion coating on the surface thereof, in which the maximum thickness of the phosphoric acid-based chemical conversion coating is 20-200 nm, recessed portions are formed on the surface of the phosphoric acid-based chemical conversion coating, and the total area of openings formed on the surface of the phosphoric acid-based chemical conversion coating by the recessed portions is 0.5-50% by area relative to the total area of the field of view when ten or more positions of the surface of the phosphoric acid-based chemical conversion coating are observed under a scanning electron microscope of 10,000 or more magnifications.

It is preferable that the openings formed on the surface of the phosphoric acid-based chemical conversion coating is of a generally circular shape, the average circle equivalent diameter of the openings of a generally circular shape is 50-1,000 nm, and, when 10 positions or more of the region of 5 μm×5 μm on the surface of the phosphoric acid-based chemical conversion coating are observed, the number of pieces of the openings of a generally circular shape is 10 pieces or more in average, or, when 10 positions or more of the cross section of the phosphoric acid-based chemical conversion coating are observed, the number of pieces of the openings of a generally circular shape is one piece or more in average per 5 μm surface length of the iron-based soft magnetic powder particles. It is preferable that a silicone resin coating is provided on the phosphoric acid-based chemical conversion coating.

In the present invention, a powder magnetic core obtained by compressively forming the powder for a powder magnetic core is also included.

Further, the present invention also includes a powder magnetic core obtained by compressively forming a powder for a powder magnetic core having a phosphoric acid-based chemical conversion coating on the surface of iron-based soft magnetic powder particles, in which, when a broken-out section of the powder magnetic core is observed, in a portion surrounded by three pieces or more of the iron-based soft magnetic powder particles, the maximum thickness of the phosphoric acid-based chemical conversion coating is 20-200 nm, recessed portions are formed on the surface of the chemical conversion coating, openings are formed on the surface of the phosphoric acid-based chemical conversion coating of the recessed portions, and the total of the length of portions where the phosphoric acid-based chemical conversion coating is adhered is 50% or more by length relative to the total of the surface length of the iron-based soft magnetic powder; and, in a portion surrounded by three pieces of more of the iron-based soft magnetic powder particles, one piece or more in average of recessed portions with 50-1,000 nm width of the opening exist relative to 5 μm length of the surface of the iron-based soft magnetic powder particles in the phosphoric acid-based chemical conversion coating, a first oxide layer, a phosphoric acid-based chemical conversion coating, and a second oxide layer are laminated in this order on the surface of the iron-based soft magnetic powder particles in a portion where the phosphoric acid-based chemical conversion coating is adhered, and the thickness of the first oxide layer is 200 nm or less (inclusive of 0 nm).

Further, the present invention also includes a powder magnetic core obtained by compressively forming a powder for a powder magnetic core having a silicone resin coating on the phosphoric acid-based chemical conversion coating.

Advantageous Effects of Invention

According to the present invention, because the phosphoric acid-based chemical conversion coating is formed by 20 nm or more of the maximum thickness on the surface of the iron-based soft magnetic powder particles, the iron-based soft magnetic powder particles can be effectively insulated from each other, and excellent insulation performance can be maintained even when a heat treatment at a high temperature is performed. Also, because the coating thickness of the phosphoric acid-based chemical conversion coating is made non-uniform and the recessed portions are formed on the surface of the phosphoric acid-based chemical conversion coating, the mechanical strength when the powder for a powder magnetic core is formed into a powder magnetic core can be increased. In other words, when the broken-out section of the powder magnetic core is observed, in a portion surrounded by three pieces or more of the iron-based soft magnetic powder particles, formation of the first oxide layer between the iron-based soft magnetic powder particles and the phosphoric acid-based chemical conversion coating is suppressed, the second oxide layer is formed on the phosphoric acid-based chemical conversion coating, and thereby the mechanical strength of the powder magnetic core is increased.

Also, when the silicone resin layer is formed on the phosphoric acid-based chemical conversion coating, the silicone resin intrudes to the recessed portions formed on the surface of the phosphoric acid-based chemical conversion coating, the retaining property of the silicone resin improves, and therefore the mechanical strength of the powder magnetic core further improves.

DESCRIPTION OF EMBODIMENTS

Figure 1:
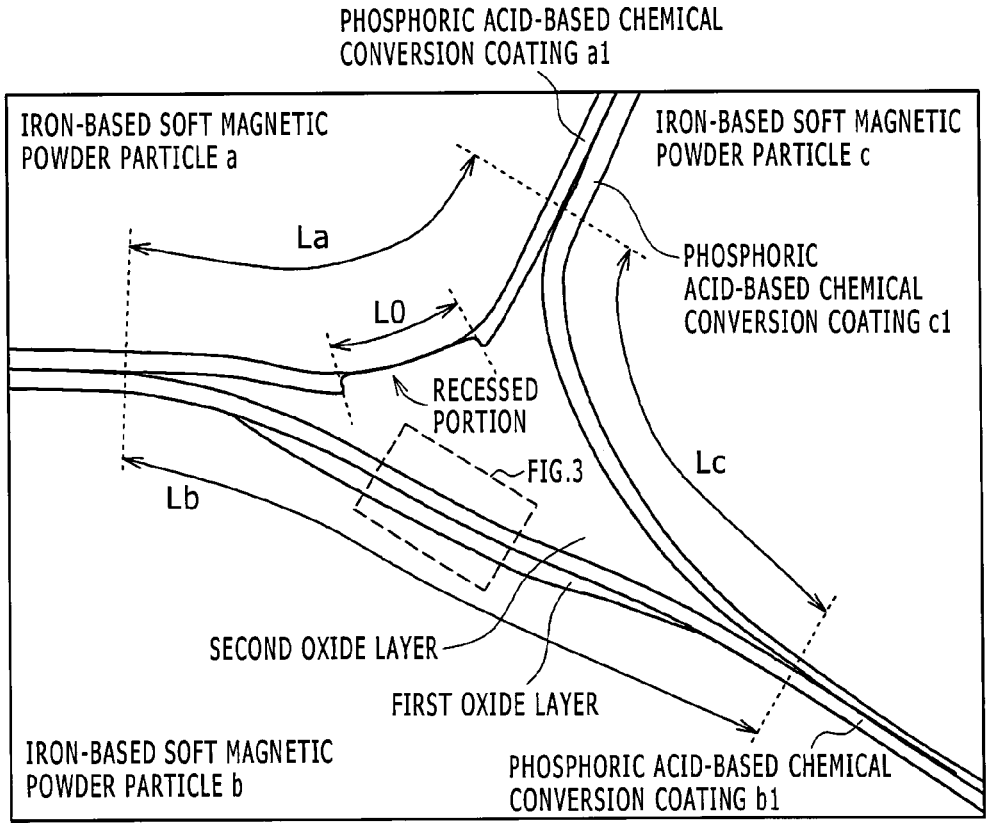
FIG. 1 is a schematic view showing a portion surrounded by three pieces of the iron-based soft magnetic powder particles out of the broken-out section of the powder magnetic core.

In order to improve the insulation performance and the mechanical strength of the powder magnetic core, the present inventors have made intensive studies. As a result, it was found out that, when the phosphoric acid-based chemical conversion coating was formed so that the maximum thickness became 20 nm or more in manufacturing the powder magnetic core using the powder for a powder magnetic core having the phosphoric acid-based chemical conversion coating on the surface of the iron-based soft magnetic powder particles, excellent insulation performance could be maintained even when a heat treatment at a high temperature was performed, the mechanical strength of the powder magnetic core was improved when the recessed portions were formed on the surface of the phosphoric acid-based chemical conversion coating, and the present invention was completed.

More specifically, in the past, in order to improve the insulation performance and the mechanical strength of the powder magnetic core, the phosphoric acid-based chemical conversion coating was formed on the surface of the iron-based soft magnetic powder particles so that the coating thickness became uniform.

On the other hand, in the present invention, because the phosphoric acid-based chemical conversion coating is formed on the surface of the iron-based soft magnetic powder particles so that the maximum thickness becomes 20 nm or more, the iron-based soft magnetic powder particles can be effectively insulated from each other, and excellent insulation performance can be maintained even when a heat treatment at a high temperature is performed. Therefore, the insulation performance of the powder magnetic core can be improved. Also, in the present invention, because the coating thickness of the phosphoric acid-based chemical conversion coating formed on the surface of the iron-based soft magnetic powder particles is made non-uniform and the recessed portions are formed on the surface of the chemical conversion coating, when the powder for a powder magnetic core is compressively formed and is subjected to a heat treatment, iron oxide (second oxide layer) is formed in the gaps between the powder particles for a powder magnetic core (for example a portion surrounded by 3-4 pieces of the iron-based soft magnetic powder particles). It is considered that the mechanical strength of the powder magnetic core improves by that this second oxide layer is formed and the gaps are filled.

The heat treatment described above is performed in order to release the strain introduced in compressively forming, and, in the present invention, the heat treatment is performed in an air atmosphere. In the past also, there was a case the heat treatment was performed in an air atmosphere, however, there was also a case the heat treatment was performed in an inert gas atmosphere (for example a nitrogen gas atmosphere). The reason is that, when a compressively formed body is subjected to heat treatment in an inert gas atmosphere, the compressively formed body is not oxidized. On the other hand, when the compressively formed body is subjected to a heat treatment in an air atmosphere, oxidation progresses to the inside of the compressively formed body. With respect to the powder for a powder magnetic core of prior arts, because the phosphoric acid-based chemical conversion coating is usually formed uniformly on the surface of the iron-based soft magnetic powder particles, oxidation of the inside of the compressively formed body occurs between the iron-based soft magnetic powder particles and the phosphoric acid-based chemical conversion coating, and an oxide layer (first oxide layer) is formed between the iron-based soft magnetic powder particles and the phosphoric acid-based chemical conversion coating. As a result of the study by the present inventors, it was found out that the first oxide layer formed between the iron-based soft magnetic powder particles and the phosphoric acid-based chemical conversion coating became a fracture origin and the mechanical strength of the powder magnetic core dropped. More specifically, in the powder for a powder magnetic core of prior arts, Fe derived from the iron-based soft magnetic powder was prevented from being diffused by the phosphoric acid-based chemical conversion coating that was uniformly formed and was not diffused to outside the phosphoric acid-based chemical conversion coating, therefore the surface of the iron-based soft magnetic powder particles was oxidized, and the inner oxide layer (first oxide layer) formed of iron oxide and iron phosphate was formed between the iron-based soft magnetic powder particles and the phosphoric acid-based chemical conversion coating. Because this inner oxide layer was formed over the entire surface of the iron-based soft magnetic powder particles, it was liable to become a fracture origin, and became a cause of a decline in the mechanical strength of the powder magnetic core.

On the other hand, with respect to the powder for a powder magnetic core of the present invention, recessed portions are formed on the surface of the phosphoric acid-based chemical conversion coating that coats the surface of the iron-based soft magnetic powder particles. When the compressively formed body obtained by compressively forming this powder for a powder magnetic core is subjected to a heat treatment in an air atmosphere, Fe derived from the iron-based soft magnetic powder passes the recessed portions formed in the phosphoric acid-based chemical conversion coating and is diffused to outside the phosphoric acid-based chemical conversion coating. Fe having been diffused forms the second oxide layer (outer oxide layer) in a gap portion surrounded by three pieces or more of the iron-based soft magnetic powder particles. With respect to the iron-based soft magnetic powder particles in which the phosphoric acid-based chemical conversion coating has been formed on the surface thereof, the gap formed by the iron-based soft magnetic powder particles is filled with the second oxide layer, a bonding force is strengthened through this second oxide layer, and therefore the mechanical strength of the powder magnetic core improves. Below, the present invention will be described in detail.

The powder for a powder magnetic core of the present invention has a phosphoric acid-based chemical conversion coating on the surface of iron-based soft magnetic powder particles, and the maximum thickness of the phosphoric acid-based chemical conversion coating is 20-200 nm. Also, recessed portions are formed on the surface of the phosphoric acid-based chemical conversion coating, and the total area of the openings formed on the surface of the phosphoric acid-based chemical conversion coating by the recessed portions is 0.5-50% by area relative to the total area of the field of view when ten or more positions of the surface of the phosphoric acid-based chemical conversion coating are observed under a scanning electron microscope of 10,000 or more magnifications. Further, in the present invention, it is preferable that the recessed portion formed on the surface of the phosphoric acid-based chemical conversion coating is an area where the thickness of the phosphoric acid-based chemical conversion coating becomes 50% or less relative to the maximum thickness thereof.

[Iron-Based Soft Magnetic Powder]

The iron-based soft magnetic powder used in the present invention is a ferromagnetic iron-based powder, and pure iron powder, iron-based alloy powder (for example Fe—Al alloy, Fe—Si alloy, Sendust, Permalloy, and the like), iron-based amorphous powder and the like can be cited specifically.

Such an iron-based soft magnetic powder can be manufactured for example by that molten iron (or molten iron alloy) is atomized by an atomizing method, is thereafter reduced, and is then ground and so on.

[Phosphoric Acid-Based Chemical Conversion Coating]

In the present invention, a phosphoric acid-based chemical conversion coating is formed on the surface of the iron-based soft magnetic powder particles. This phosphoric acid-based chemical conversion coating is a coating that can be formed by a chemical conversion treatment by a treatment liquid in which a compound containing phosphorus (for example orthophosphoric acid ($H_3PO_4$)) is dissolved, and becomes a coating containing Fe element derived from the iron-based soft magnetic powder.

The maximum thickness of the coating thickness of the phosphoric acid-based chemical conversion coating is 20-200 nm. When the maximum thickness is thinner than 20 nm, the insulation effect by the phosphoric acid-based chemical conversion coating is not exhibited. Also, when the phosphoric acid-based chemical conversion coating is excessively thin, the adhesive property of the silicone resin formed on the phosphoric acid-based chemical conversion coating deteriorates, and therefore the insulation performance when the powder for a powder magnetic core is formed into a powder magnetic core deteriorates. The maximum thickness of the phosphoric acid-based chemical conversion coating is preferably 30 nm or more, and more preferably 40 nm or more. However, when the maximum thickness exceeds 200 nm, the insulation effect saturates, the phosphoric acid-based chemical conversion coating becomes excessively thick, the density of the powder magnetic core cannot be increased, and the magnetic flux density lowers. Therefore, the maximum thickness is made 200 nm or less, preferably 150 nm or less, and further more preferably 100 nm or less.

Also, recessed portions are formed on the surface of the phosphoric acid-based chemical conversion coating. It is preferable that the recessed portion is a region where the thickness becomes 50% or less relative to the maximum thickness, and means for example a region recessed from an imaginary 50% plane that is obtained by connecting points where the thickness becomes 50% relative to the maximum thickness. By forming the recesses (recessed portions) on the surface of the phosphoric acid-based chemical conversion coating, formation of the first oxide layer between the iron-based soft magnetic powder particles and the phosphoric acid-based chemical conversion coating when a heat treatment is performed in an air atmosphere is suppressed, the second oxide layer is formed on the phosphoric acid-based chemical conversion coating, and the mechanical strength of the powder magnetic core is increased. Also, because the silicone resin formed on the phosphoric acid-based chemical conversion coating intrudes to the recessed portions formed on the surface of the phosphoric acid-based chemical conversion coating and the retaining property of the silicone resin is enhanced, the mechanical strength of the powder magnetic core increases.

With respect to the recessed portion, it is preferable that the difference in the coating thickness is large between the recessed portions and portions other than the recessed portions and the thickness sharply changes. In other words, it is preferable that the recessed portions formed on the surface of the phosphoric acid-based chemical conversion coating has a shape the thickness of the phosphoric acid-based chemical conversion coating sharply changes like a pit (hole) and a groove.

The thickness of the phosphoric acid-based chemical conversion coating in the bottom part of the recessed portion may be 0% relative to the maximum thickness. In other words, the thickness of the phosphoric acid-based chemical conversion coating in the bottom part of the recessed portion may be 0 nm, and the surface of the iron-based soft magnetic powder may be exposed. When the thickness of the phosphoric acid-based chemical conversion coating in the bottom part of the recessed portion is thin or the surface of the iron-based soft magnetic powder is exposed, in forming the powder magnetic core, Fe derived from the iron-based soft magnetic powder is diffused from this portion to outside the phosphoric acid-based chemical conversion coating, therefore the second oxide layer is formed in the gap portion surrounded by three pieces or more of the iron-based soft magnetic powder particles, and the mechanical strength of the powder magnetic core improves (refer to FIG. 1 which will be described below).

With respect to the coating thickness of the phosphoric acid-based chemical conversion coating, and the average value can be obtained by that the iron-based soft magnetic powder particles formed with the phosphoric acid-based chemical conversion coating (may be hereinafter simply referred to as "iron powder with phosphoric acid-based chemical conversion coating" are embedded in a resin and polished, or the cross section is exposed by cross section polisher working (CP working), 10 or more fields of view are observed and measured under an electron microscope (for example a scanning electron microscope or transmission electron microscope) of 10,000 or more magnifications.

When the recessed portion has a shape formed by sharp change of the coating thickness of the phosphoric acid-based chemical conversion coating as a pit and a groove, the shape of the recessed portion can be measured by that the iron powder with the phosphoric acid-based chemical conversion coating is embedded in a resin and polished, or the cross section is exposed by CP working, 10 or more fields of view are observed under an electron microscope (for example a scanning electron microscope or transmission electron microscope) with 10,000 or more magnifications.

When the recessed portion has a shape formed by a smooth change of the coating thickness of the phosphoric acid-based chemical conversion coating, the shape of the recessed portion can be measured by that polishing and observation are repeated in the depth direction of the phosphoric acid-based chemical conversion coating for three-dimensional analysis.

It is important that the total area of the openings formed on the surface of the phosphoric acid-based chemical conversion coating by the recessed portions is 0.5-50% by area relative to the total area of the fields of view when 10 or more positions of the surface of the phosphoric acid-based chemical conversion coating are observed under a scanning electron microscope with 10,000 or more magnifications. When the total area of the openings is less than 0.5% by area relative to the total area of the fields of view, because the recessed portions are excessively less, the adhesive property of the silicone resin deteriorates, and the insulation performance and the mechanical strength of the powder magnetic core cannot be improved. Therefore, the total area of the openings relative to the total area of the fields of view is made 0.5% or more by area, preferably 1% or more by area, and more preferably 3% or more by area. However, when the total area of the openings relative to the total area of the fields of view exceeds 50% by area, a portion where the coating thickness of the phosphoric acid-based chemical conversion coating becomes thin relative to the maximum coating thickness excessively increases, and therefore the insulation effect by the phosphoric acid-based chemical conversion coating is not exhibited. Also, when a portion where the coating thickness of the phosphoric acid-based chemical conversion coating is thin relative to the maximum coating thickness excessively increases, the adhesive property of the silicone resin deteriorates, and the insulation performance of the powder magnetic core cannot be improved. Further, when a portion where the coating thickness of the phosphoric acid-based chemical conversion coating is thin relative to the maximum coating thickness excessively increases and particularly a portion where the iron-based soft magnetic powder is exposed excessively increases, the phosphoric acid-based chemical conversion coating is taken in by iron oxide formed in a heat treatment and becomes a fracture origin, and therefore the mechanical strength of the powder magnetic core lowers. Therefore, the total area of the openings relative to the total area of the fields of view is made 50% or less by area, preferably 30% or less by area, and more preferably 10% or less by area.

With respect to the ratio of the total area of the openings to the total area of the fields of view, the area ratio of the recessed portions can be measured by embedding the iron-based soft magnetic powder particles in a resin, exposing a flat surface by a method such as polishing and the like, subjecting the exposed surface to a phosphoric acid treatment, taking a photo enhancing contrast on the recessed portions and the portions other than the recessed portions under an electron microscope (for example a scanning electron microscope, transmission electron microscope and the like) of magnifications matching the size of the recessed portion, and performing image analysis.

The shape of the openings formed on the surface of the phosphoric acid-based chemical conversion coating is not particularly limited, just should be a pit-shape, groove-shape, linear shape and the like for example, and is more preferably a pit-shape. With respect to the recessed portions whose shape of the openings is a pit-shape, because dispersion is easy over the entire surface of the phosphoric acid-based chemical conversion coating, the adhesive property of the silicone resin can be improved.

In concrete terms, the shape of the openings may be a generally circular shape. The generally circular shape means to include a circular shape, and may be flattened to some extent.

It is preferable that the average circle equivalent diameter of the openings having generally circular shape is 50-1,000 nm. By making the average circle equivalent diameter 50 nm or more, the adhesive property of the silicone resin improves, and the insulation performance and the mechanical strength of the powder magnetic core can be improved. The average circle equivalent diameter of the opening is more preferably 80 nm or more, and further more preferably 100 nm or more. However, when the average circle equivalent diameter of the openings becomes excessively large, the adhesive property of the silicone resin deteriorates, and therefore it is probable that the insulation performance of the powder magnetic core cannot be improved. Accordingly, the average circle equivalent diameter of the openings is preferably 1,000 nm or less, more preferably 500 nm or less, and further more preferably 250 nm or less.

The average circle equivalent diameter of the openings can be calculated by observing 10 or more fields of view of the surface of the phosphoric acid-based chemical conversion coating, measuring the circle equivalent diameter of each opening observed within the field of view, and averaging the measured result.

It is preferable that, when 10 positions or more of the region of 5 μm×5 μm on the surface of the phosphoric acid-based chemical conversion coating are observed, the number of pieces of the openings of a generally circular shape is 10 pieces or more in average. By making the number of pieces of the openings of a generally circular shape 10 pieces or more in average, the second oxide layer can be easily formed on the phosphoric acid-based chemical conversion coating, and the mechanical strength of the powder magnetic core improves. Also, the adhesive property of the silicone resin improves, and the insulation performance and the mechanical strength of the powder magnetic core can be improved. The number of pieces of the openings of a generally circular shape is more preferably 50 pieces or more in average, and further more preferably 100 pieces or more in average. Although the upper limit of the number of pieces of the openings of a generally circular shape is not particularly limited, it should just be 250 pieces or less for example.

The number of pieces of the openings of a generally circular shape can be measured also by embedding the powder for a powder magnetic core formed with the phosphoric acid-based chemical conversion coating thereon in a resin and observing the cross section. The number of pieces of the openings of a generally circular shape per 5 μm surface length of the iron-based soft magnetic powder is preferably one piece or more in average, more preferably 5 pieces or more in average, and further more preferably 10 pieces or more in average. Although the upper limit of the number of pieces of the openings of a generally circular shape is not particularly limited, it should just be 25 pieces or less for example.

Also, the number of pieces of the openings of a generally circular shape may be measured by surface analysis, and may be measured by cross section analysis. There is a tendency that the more the number of pieces measured by surface analysis is, the more the number of pieces measured by cross section analysis becomes.

It is preferable that the phosphoric acid-based chemical conversion coating contains Ni. When a phosphoric acid treatment is performed using a treatment liquid containing Ni, it is easy to form the phosphoric acid-based chemical conversion coating uniformly, and, when the treatment condition is controlled, fine pits can be formed. In other words, it was known that, when the phosphoric acid treatment was performed adjusting the concentration of the treatment liquid and the treatment time, the pits could be formed on the surface of the phosphoric acid-based chemical conversion coating. By arranging the phosphoric acid-based chemical conversion coating that contains Ni controlling the treatment condition, the structure of the present invention can be achieved. Also, because portions other than the pits come to have generally same and uniform coating thickness, by forming the pits, the insulation performance as the phosphoric acid coating is also maintained while imparting the effect of improving the insulation property and the mechanical strength of the powder magnetic core described above.

Although the action and effect of containment of Ni are not clear, Ni is recognized to exist so as to be dispersed within the phosphoric acid-based chemical conversion coating, and it is considered that, by presence of Ni, the event Fe is eluted and a phosphoric acid treatment reaction occurs in the vicinity of the iron powder is promoted, and formation of the coating becomes easy. At that time, a portion where Ni is present is considered to become thinner than a portion where Ni is not present and to form the pits.

On the other hand, although the phosphoric acid-based chemical conversion coating can be formed even by a phosphoric acid treatment containing Co which is disclosed in Japanese Patent No. 4,044,591 for example, this phosphoric acid-based chemical conversion coating is formed so that the coating thickness becomes uniform, and the structure of the present invention is hardly achieved even when the treatment condition is controlled. In order to form the pits in the phosphoric acid-based chemical conversion coating, it is necessary to make the thickness of the coating thin to approximately 10 nm or less for example. In the state, because the coercive force of the silicone resin coating is weak and the phosphoric acid-based chemical conversion coating does not exhibit the effect as an insulation coating, the insulation performance of the powder magnetic core deteriorates.

Also, when the phosphoric acid treatment is performed using a treatment liquid not containing Ni, either a reaction product is less or the amount of the reaction product turned to a coating is less and the phosphoric acid-based chemical conversion coating is formed into an island shape and so on, and a coating in which the portions having extremely thin coating thickness are present by 50% or more by area based on the whole is liable to be formed.

The phosphoric acid-based chemical conversion coating may further contain, as other elements, the compositions such as Na, K, N, S, Cl and the like derived from the additives added to the treatment liquid according to the necessity in order to control pH of the treatment liquid in which the compound containing P has been dissolved and to promote the reaction. It is preferable to contain K particularly out of these elements in order to improve the heat resistance of the phosphoric acid-based chemical conversion coating.

With respect to the phosphoric acid-based chemical conversion coating, it is preferable that the content of Al and Mg is suppressed, and it is more preferable that the phosphoric acid-based chemical conversion coating does not contain Al and Mg. The reason is that, when a treatment liquid in which a compound containing P and a compound containing Ni are dissolved is used in forming the phosphoric acid-based chemical conversion coating, if Al and Mg are also contained in the treatment liquid, the solubility of Ni in the treatment liquid lowers, and there is a case the treatment liquid having a desired Ni content cannot be produced.

<Method for Forming Phosphoric Acid-Based Chemical Conversion Coating>

It is possible to produce the powder for a powder magnetic core of the present invention by any manner. For example, the powder for a powder magnetic core of the present invention can be formed by mixing a solution (treatment liquid) obtained by dissolving a compound containing P in an aqueous solvent with the iron-based soft magnetic powder, and drying the same.

As the aqueous solvent, water, hydrophilic organic solvent such as alcohol, ketone and the like, and the mixture thereof can be used, and known surfactant may be added to the solvent.

As the compound containing P, orthophosphoric acid ($H_3PO_4$: P source), $(NH_2OH)_2.H_2PO_4$ (P source), and the like can be cited.

In order to control pH and to promote the reaction, the treatment liquid may also include additives such as an alkali salt such as Na, K and the like, ammonia and ammonium salt, sulfate, nitrate, phosphate and the like. As the sulfate, $(NH_2OH)_2.H_2SO_4$ and the like can be cited for example. As the phosphate, $KH_2PO_4$, $NaH_2PO_4$, $(NH_2OH)_2.H_2PO_4$ and the like can be cited for example. Among them, $KH_2PO_4$ and $NaH_2PO_4$ contribute to pH control of the treatment liquid, and $(NH_2OH)_2.H_2SO_4$ and $(NH_2OH)_2.H_2PO_4$ contribute to reaction promotion of the treatment liquid. Also, the alkali metal such as Na, K and the like derived from a pH control agent and elements such as P, S and the like derived from a reaction promotion agent come to be contained in the phosphoric acid-based chemical conversion coating. Particularly, when K is contained in the phosphoric acid-based chemical conversion coating, the effect of suppressing formation of a semiconductor is also exerted. Also, it is preferable that a compound containing Al is not contained in the treatment liquid.

The additive amount of each compound with respect to the iron-based soft magnetic powder only has to be one in which the composition of the phosphoric acid-based chemical conversion coating formed becomes within the range described above. For example, a soft magnetic powder formed with the phosphoric acid-based chemical conversion coating is obtained by producing a treatment liquid having a solid content of approximately 0.1-10 mass %, adding approximately 1-10 mass parts to 100 mass parts of the iron powder, mixing the same by known mixer, ball mill, kneader, V-type mixer, pelletizer, and the like, and drying the same at 150-250° C. in an air atmosphere, under reduced pressure, or under vacuum. After drying, the soft magnetic powder formed with the phosphoric acid-based chemical conversion coating may be made to pass through a sieve with the opening of approximately 200-500 μm.

Although the method for forming the recessed portions in the phosphoric acid-based chemical conversion coating is not particularly limited also, methods of (1)-(3) shown below are recommendable. Also, the present invention is not limited to these methods of (1)-(3).

(1) Using a treatment liquid containing Ni, the surface of the iron-based soft magnetic powder is subjected to a phosphoric acid treatment aiming both of increase of the thickness of the coating and formation of the pits. With respect to the treatment liquid containing Ni, nickel pyrophosphate ($Ni_2P_2O_7$), nickel nitrate [$Ni(NO_3)_2$], nickel sulfate, nickel chloride and the like for example can be used as a compound of Ni source.

When phosphoric acid content of the treatment liquid is made 1.0-3.5 mass % and Ni ion content is made 0.03-0.15 mol/L, the recessed portions (particularly the recessed portions having a pit-like shape of the openings) can be formed on the surface of the phosphoric acid-based chemical conversion coating in a treatment time with which the forming amount of the phosphoric acid-based chemical conversion coating becomes much and the maximum coating thickness becomes 200 μm or less. As the phosphoric acid content of the treatment liquid is less and the treatment time is shorter, the pit size and the number of pieces of the pit tend to become large.

(2) In mixing the iron-based soft magnetic powder and the treatment liquid, mechanical stirring is performed, and the phosphoric acid treatment (formation of the phosphoric acid-based chemical conversion coating) and the step of forming the recessed portions on the surface of the phosphoric acid-based chemical conversion coating are performed simultaneously, or the recessed portions may be formed on the surface of the phosphoric acid-based chemical conversion coating by subjecting the iron-based soft magnetic powder to the phosphoric acid treatment and thereafter performing mechanical stirring by 30 min or more. By slippage of the iron-based soft magnetic powder with each other, the recessed portions are formed on the surface of the phosphoric acid-based chemical conversion coating in a linear shape (groove shape) or in a pit shape.

Mechanical stirring can be performed by existing methods.

When hard particles finer and having larger unevenness than the iron-based soft magnetic powder particles are mixed together, more recessed portions can be shaped. As the hard particles, oxide particles are preferable, $Fe_2O_3$ is more preferable, and formation as it is without sorting is possible. Also, when iron powder with an irregular shape having larger unevenness is used, more recessed portions can be formed.

(3) The iron-based soft magnetic powder with an irregular shape having large unevenness is used, the phosphoric acid treatment liquid is mixed to the iron-based soft magnetic powder, is immediately thereafter exposed to a gas flow for slow drying, thereby the difference in the drying rate is caused between the projected portions and the recessed portions of the iron-based soft magnetic powder particles, or the difference in the drying rate is caused between positions where the iron-based soft magnetic powder particles do not contact each other and the gas flows and positions where the iron-based soft magnetic powder particles contact each other and the gas does not flow, and thereby a distribution can be imparted to the thickness of the phosphoric acid-based chemical conversion coating formed. For example, by putting the iron-based soft magnetic powder attached with the phosphoric acid treatment liquid over the entire surface thereof in a container, pressurizing a dry gas of 70° C. for example from the bottom of the container to cause a flow, a distribution can be formed in the coating thickness of the phosphoric acid-based chemical conversion coating.

[Silicone Resin Coating]

With respect to the powder for a powder magnetic core of the present invention, a silicone resin coating may be further formed on the phosphoric acid-based chemical conversion coating. Thus, at the time of completion of the crosslinking/hardening reaction (in compressing) of the silicone resin, the powder particles are securely bonded with each other. Also, Si—O bond excellent in heat resistance can be formed, and the thermal stability of the insulation coating can be improved.

With respect to the silicone resin, in one in which hardening is slow, the powder is sticky and handling performance after forming a coating is inferior, and therefore one having more trifunctional T units ($RSiX_3$: X is a hydrosable group) than bifunctional D units ($R_2SiX_2$: X is same to the above) is preferable. However, when tetrafunctional Q units ($SiX_4$: X is same to the above) are contained much, the powder particles are securely bonded with each other in preliminary hardening, and there is a case the forming steps to follow cannot be performed. Therefore, T unit of the silicone resin is preferably 60 mol % or more, more preferably 80 mol % or more, and most preferably 100 mol %.

Also, as the silicone resin, a methylphenyl silicone resin in which R described above is a methyl group or a phenyl group is common, and it is known that one having more phenyl groups has higher heat resistance. However, in such heat treatment condition of a high temperature as employed in the present invention, presence of the phenyl group was not so effective. It is considered that bulkiness of the phenyl group might disrupt a dense glass-like net structure and might adversely deteriorate the thermal stability and the compound formation inhibitory effect against iron. Therefore, in the present invention, to use the methylphenyl silicone resin with 50 mol % or more methyl group (for example KR255, KR311 and the like made by Shin-Etstu Chemical Co., Ltd.) is preferable, that with 70 mol % or more methyl group (for example KR300 and the like made by Shin-Etstu Chemical Co., Ltd.) is more preferable, and the methyl silicone resin not having the phenyl group at all (for example KR251, KR400, KR220L, KR242A, KR 240, KR500, KC89 and the like made by Shin-Etstu Chemical Co., Ltd., as well as SR2400 and the like made by Dow Corning Toray Co., Ltd.) is most preferable. Also, the ratio and functionality of the methyl group and phenyl group of the silicone resin (coating) can be analyzed by FT-IR and the like.

It is preferable that the attaching amount of the silicone resin coating is adjusted so as to become 0.05-0.3 mass % when the powder for a powder magnetic core formed with the phosphoric acid-based chemical conversion coating and the silicone resin coating in this order is made 100 mass %. When the attaching amount of the silicone resin coating is less than 0.05 mass %, the powder for a powder magnetic core is inferior in insulation performance, and the electrical resistance drops. Also, when the attaching amount of the silicone resin coating is more than 0.3 mass %, the density of the compressed powder body obtained can be hardly increased.

The thickness of the silicone resin coating is preferably 1-200 nm, and more preferably 20-150 nm.

Also, it is preferable that the total thickness of the phosphoric acid-based chemical conversion coating and the silicone resin coating is made 250 nm or less. When the total thickness exceeds 250 nm, there is a case drop of the magnetic flux density becomes large. Also, by performing a heat treatment after compressive forming, there may be a case a coating is not formed by cracking in a portion surrounded by three pieces or more of the iron-based soft magnetic powder portions out of the silicone resin coating.

<Method for Forming Silicone Resin Coating>

The silicone resin coating can be formed for example by mixing a silicone resin solution obtained by dissolving the silicone resin in an alcohol group, petroleum-based organic solvent and the like such as toluene, xylene and the like and the iron-based soft magnetic powder having the phosphoric acid-based chemical conversion coating (iron powder with phosphoric acid-based chemical conversion coating), and then evaporating the organic solvent.

The additive amount of the silicone resin with respect to the iron powder with phosphoric acid-based chemical conversion coating only has to be such an amount with which the attaching amount of the silicone resin coating formed becomes the range described above. For example, a resin solution produced so that the solid content becomes approximately 2-10 mass % should just be added by approximately 0.5-10 mass parts to 100 mass parts of the iron powder with phosphoric acid-based chemical conversion coating described above for mixing and be dried. When the additive amount of the silicone resin solution is less than 0.5 mass part, mixing might take time and the coating might become non-uniform. On the other hand, when the additive amount of the silicone resin solution exceeds 10 mass parts, drying might take time and drying might become insufficient. The resin solution may be appropriately heated beforehand. With respect to the mixer, one similar to those described above can be used.

In drying, it is preferable to sufficiently evaporate and volatilize the organic solvent by performing heating to a temperature at which the organic solvent used is volatilized and which is below the hardening temperature of the silicone resin. As a concrete drying temperature, approximately 60-80° C. is appropriate in the case of the alcohol group and the petroleum-based organic solvent described above. It is preferable to be passed through a sieve with the opening of approximately 300-500 μm after drying in order to remove aggregated undissolved lumps.

<Preliminary Hardening>

It is recommendable to heat the iron powder with phosphoric acid-based chemical conversion coating formed with the silicone resin coating (may be hereinafter simply referred to as "iron powder with silicone resin coating") after drying and preliminarily hardening the silicone resin coating. The preliminary hardening is a treatment of finishing a softening process in hardening the silicone resin coating in a powder state. By this preliminary hardening treatment, the flowability of the iron powder with silicone resin coating can be secured in forming at a warm temperature (approximately 100-250° C.). As a concrete method, although a method of heating the iron powder with silicone resin coating for a short time at a temperature near the hardening temperature of the silicone resin is convenient, a method of using chemicals (hardening agent) also can be utilized. The difference between the preliminary hardening and the hardening treatment (entirely hardening process which is not preliminary) is that, in the preliminary hardening process, the powder particles do not entirely adhered and fixed to each other and can be easily disintegrated, whereas in a high temperature heating and hardening treatment performed after forming the powder, the resin is hardened and the powder particles are adhered and fixed to each other. By the entirely hardening treatment, the strength of the formed body improves.

By performing disintegration after the silicone resin is preliminarily hardened as described above, the powder excellent in flowability is obtained, and charging to the forming die like sand in compressive forming becomes possible. Without the preliminary hardening, there may be a case for example that the powder particles are adhered to each other in warm temperature forming and charging to the forming die in a short time becomes hard. In the actual operation, improvement of the handling performance is significantly meaningful. Also, it has been found out that the specific resistance of the powder magnetic core obtained remarkably improves by preliminary hardening. Although the reason is not clear, it is considered that mutual adhesion of the iron powder particularly would improve in hardening.

When preliminary hardening is performed by the short time heating method, it is preferable to perform the heating treatment for 5-100 min at 100-200° C., and more preferably for 10-30 min at 130-170° C. It is preferable to be passed through the sieve as described above after the preliminary hardening also.

[Lubricant]

It is preferable to further mix a lubricant in the powder for a powder magnetic core of the present invention. By an action of the lubricant, the friction resistance between the iron powder particles or between the iron powder particles and the inner wall of the forming die in compressively forming the powder for a powder magnetic core can be reduced, and the die galling of the formed body and heat generation in forming can be prevented. In order to effectively exert such an effect, it is preferable that the lubricant is contained by 0.2 mass % or more in the total amount of the mixture of the powder for a powder magnetic core and the lubricant. However, because increase of the lubricant amount is against increase of the density of the compressed powder body, it is preferable to be suppressed to 0.8 mass % or less. Also, in compressively forming, when forming is performed after the lubricant is coated on the inner wall surface of the forming die (die wall lubrication forming), the lubricant amount of less than 0.2 mass % will do.

With respect to the lubricant, those known from the past can be used. In concrete terms, a metal salt powder of stearic acid such as zinc stearate, lithium stearate, calcium stearate and the like, fatty acid amide such as polyhydroxycarboxylic acid amide, ethylenebisstearyl amide, (N-octadecenyl) hexadecanoic acid amide and the like, paraffin, wax, natural or synthetic resin derivative and the like can be cited. These lubricants can be used by single or can be used by combination of two kinds or more.

[Compressive Forming]

The powder for a powder magnetic core of the present invention is used for manufacturing the powder magnetic core. In order to manufacture the powder magnetic core, the powder is compressively formed first. The compressively forming method is not particularly limited, and methods known from the past can be employed.

The appropriate condition of the compressive forming is 490-1,960 MPa, and more preferably 790-1,180 MPa in terms of the contact pressure. Particularly, it is preferable to perform compressive forming in a condition of 980 MPa or more because the powder magnetic core with 7.50 g/cm$^3$ or more density is easily obtained, and the powder magnetic core having high strength and excellent in magnetic property (magnetic flux density) is obtained. With respect to the forming temperature, both of the room temperature forming and the warm temperature forming (100-250° C.) are possible. The warm temperature forming with die wall lubrication forming is preferable because a powder magnetic core having a high strength is obtained.

[Heat Treatment]

In the present invention, because the insulation coating is excellent in heat resistance, the compressed powder body after compressive forming can be annealed at a high temperature. Thus, the hysteresis loss of the powder magnetic core can be reduced. The annealing temperature then is preferably 500° C. or above, and more preferably 550° C. or above. It is preferable to perform the step at a higher temperature unless the specific resistance of the powder magnetic core deteriorates. The upper limit of the annealing temperature is preferably 700° C., and more preferably 650° C. When the annealing temperature exceeds 700° C., there is a case the insulation coating is broken.

With respect to the atmosphere in annealing, an oxidizing atmosphere such as the atmospheric air is preferable.

Although the heat treatment time is not particularly limited unless the specific resistance deteriorates, in order to reduce the hysteresis loss of the powder magnetic core, 20 min or more is preferable, and 30 min or more is more preferable. However, when annealing is performed for long hours at a temperature of 500° C. or above, oxidation of the iron powder is severe particularly in the vicinity of the surface of the formed body, even when the recessed portions exist in the phosphoric acid coating, formation of the iron oxide between the phosphoric acid coating—the iron powder which is not preferable in terms of the structure is possibly promoted, and it is concerned that the mechanical strength lowers. Therefore, the annealing time is preferably 2 hours or less, and more preferably 1 hour or less.

[Powder Magnetic Core]

The powder magnetic core of the present invention can be obtained by cooling to the room temperature after the heat treatment step.

Because the powder magnetic core of the present invention is obtained by heat treatment at a high temperature, the iron loss (particularly the hysteresis loss) can be reduced. More specifically, the powder magnetic core having the specific resistance of 65 μΩ·m or more (preferably 100 μΩ·m or more) can be obtained.

When the broken-out section of the powder magnetic core of the present invention is observed, the stress directly applied to the phosphoric acid-based chemical conversion coating is small, and it is configured that, in a portion surrounded by three pieces or more of the iron-based soft magnetic powder particles, the total of the length of the portions where the phosphoric acid-based chemical conversion coating is adhered is 50% or more by length relative to the total of the surface length of the iron-based soft magnetic powder particle, one piece or more in average of the recessed portions with 50-1,000 nm width of the opening exist relative to 5 μm length of the surface of the iron-based soft magnetic powder particle in the phosphoric acid-based chemical conversion coating, the first oxide layer (inner oxide layer), the phosphoric acid-based chemical conversion coating, and the second oxide layer (outer oxide layer) are laminated in this order on the surface of the iron-based soft magnetic powder particles in a portion where the phosphoric acid-based chemical conversion coating is adhered. Also, the silicone resin does not form a coating, and exists by being taken into the second oxide layer.

Out of the broken-out section of the powder magnetic core related to the present invention, as an example, a schematic view showing a portion surrounded by three pieces of the iron-based soft magnetic powder particles a-c is shown in FIG. 1. In the iron-based soft magnetic powder particles a-c shown in FIG. 1, the phosphoric acid-based chemical conversion coatings a1-c1 are formed respectively. A recessed portion is formed in the phosphoric acid-based chemical conversion coating a1 formed on the surface of the iron-based soft magnetic powder particle a, and the first oxide layer is formed between the iron-based soft magnetic powder particle b and the phosphoric acid-based chemical conversion coating bl. In the portion surrounded by the iron-based soft magnetic powder particles a-c, the second oxide layer is formed. La-Lc show the surface length of the iron-based soft magnetic powder particles a-c in the portion surrounded by three pieces of the iron-based soft magnetic powder particles, and L0 shows the length of a part where the phosphoric acid-based chemical conversion coating is not adhered.

In the present invention, it is important that the thickness of the first oxide layer is 200 nm or less (inclusive of 0 nm). When the first oxide layer is formed to be thicker than 200 nm, this first oxide layer becomes a fracture origin of fracture, and the mechanical strength of the powder magnetic core lowers. The event that the first oxide layer becomes an origin can be evaluated by observing the broken-out section, and when the broken-out section is observed, because the iron-based soft magnetic powder and the iron oxide are recognized in a large area of both surfaces, the event that a crack was generated from the origin of a gap between the iron-based soft magnetic powder particle and the iron oxide and the crack developed can be confirmed. On the other hand, when the thickness of the first oxide layer formed between the iron-based soft magnetic powder particle and the phosphoric acid-based chemical conversion coating is 200 nm or less, the mechanical strength of the powder magnetic core is increased, the broken-out section is observed to be in a state the iron oxide, the phosphoric acid-based chemical conversion coating and the iron-based soft magnetic powder particles are finely dispersed, and therefore it is confirmed that there is no peculiar position liable to become a fracture origin, and the powder magnetic core is broken so as to be torn off. The thickness of the first oxide layer is preferably 150 nm or less, more preferably 100 nm or less, further more preferably 50 nm or less, specially preferably 15 nm or less, still more preferably 10 μm or less, and most preferably 0 nm.

With respect to the thickness of the first oxide layer, three or more fields of view of the broken-out section should just be observed under an electron microscope (for example scanning electron microscope or transmission electron microscope) of 10,000 or more magnifications to measure the maximum thickness.

In the powder magnetic core of the present invention, the total of the length of portions where the phosphoric acid-based chemical conversion coating is adhered is 50% or more by length relative to the total of the surface length of the iron-based soft magnetic powder particles in a portion surrounded by three pieces or more of the iron-based soft magnetic powder particles. The total of the surface length of the iron-based soft magnetic powder particles in a portion surrounded by three pieces or more of the iron-based soft magnetic powder particles is expressed by La+Lb+Lc in FIG. 1, the length of portions where the phosphoric acid-based chemical conversion coating is not adhered is expressed by L0 in FIG. 1, and therefore the rate of the total of the length of portions where the phosphoric acid-based chemical conversion coating is adhered (La+Lb+Lc−L0) to the total of the surface length of the iron-based soft magnetic powder particles in a portion surrounded by three pieces of the iron-based soft magnetic powder particles (La+Lb+Lc) is expressed by (La+Lb+Lc−L0)/(La+Lb+Lc)×100.

By coating 50% or more of the surface area of the iron-based soft magnetic powder particles with the phosphoric acid-based chemical conversion coating, excellent insulation performance can be maintained even when a heat treatment is performed at a high temperature. Therefore, the total of the length of portions where the phosphoric acid-based chemical conversion coating is adhered is preferably 60% or more by length, and more preferably 70% or more by length. Although the upper limit of the total of the length of portions where the phosphoric acid-based chemical conversion coating is adhered is not particularly limited, it may be 100% by length.

Also, it is necessary that one piece or more in average of recessed portions with the opening of 50-1,000 nm width exist relative to 5 μm surface length of the iron-based soft magnetic powder particles in the phosphoric acid-based chemical conversion coating. If the number of pieces of the recessed portion is less than one piece in average, because the number of pieces of the recessed portion is too less, when a heat treatment is performed, the second oxide layer is not sufficiently formed in a portion surrounded by three pieces or more of the iron-based soft magnetic powder particles, and therefore the mechanical strength of the powder magnetic core cannot be increased. Accordingly, the number of pieces of the recessed portion with the opening of 50-1,000 nm width is made one piece or more in average, preferably 3 pieces or more in average, and more preferably 8 pieces or more in average. Although the upper limit of the number of pieces of the recessed portion with the opening of 50-1,000 nm width is not particularly limited, for example, it should just be 20 pieces or less in average.

The number of pieces of the recessed portion with the opening of 50-1,000 nm width relative to 5 μm surface length of the iron-based soft magnetic powder particles may be measured by subjecting the broken-out section of the powder magnetic core to a phosphoric acid treatment and observing the same under an electron microscope (for example scanning electron microscope, transmission electron microscope and the like), or when the width of the opening is 1 μm or more, it may be measured under a digital microscope and the like with 1,000 magnifications in a state of the iron-based soft magnetic powder formed with the phosphoric acid-based chemical conversion coating. Also, the number of pieces of the fields of view should just be 10 fields of view.

Also, in the present invention, instead of measuring the area ratio of the opening formed on the surface of the phosphoric acid-based chemical conversion coating by the recessed portion formed on the surface of the phosphoric acid-based chemical conversion coating, it is also possible to observe the broken-out section of the powder magnetic core and to measure the length of the recessed portion relative to the surface length of the iron-based soft magnetic powder (length ratio). Because the area ratio and the length ratio are not strictly equal to each other, there is a difference (the large/small relation changes according to the size or the distribution state of the recessed portions). When the length ratio is to be obtained, the length ratio of the recessed portion is preferably 1-50% by length, and more preferably 3-10% by length. The length ratio should just be measured by observing the portion surrounded by three pieces or more of the iron-based soft magnetic powder particles under an electron microscope (for example scanning electron microscope, transmission electron microscope and the like) out of the broken-out section of the powder magnetic core.

The powder magnetic core of the present invention is used suitably particularly to the magnetic core of electromagnetic parts.

EXAMPLE

Below, the present invention will be described in detail based on an example. However, the example described below does not restrict the present invention, and all of implementations of change within a range not departing from the objects described above and below is to be included in the technical range of the present invention. Also, "part" means "mass part" and "%" means "mass %" respectively unless otherwise stated.

The powder for a powder magnetic core formed with the phosphoric acid-based chemical conversion coating and the silicone resin coating in this order on the surface of the iron-based soft magnetic powder particles was manufactured and was compressively formed, and test samples was manufactured.

(Formation of Phosphoric Acid-Based Chemical Conversion Coating)

In (a) below, the powder for a powder magnetic core for manufacturing the test samples was manufactured, and in (b) below, a specimen for evaluating the properties of the phosphoric acid-based chemical conversion coating formed on the surface of the iron-based soft magnetic powder particles was manufactured.

(a) The phosphoric acid-based chemical conversion coating was formed on the surface of the iron-based soft magnetic powder particles using a phosphoric acid aqueous solution.

As the iron-based soft magnetic powder, pure iron powder [made by Kobe Steel; Atmel® ML35N; 140 μm average grain size; the content of aluminum element and magnesium element is 0 mass %] was screened using a sieve with the opening of 300 μm, and the pure iron powder having passed through the sieve was used.

As the phosphoric acid aqueous solution, a product obtained by diluting a chemical A: 100 ml obtained by mixing water: 50 parts, $KH_2PO_4$: 35 parts, $H_3PO_4$: 10 parts, and $(NH_2OH)_2.H_2PO_4$: 10 parts with water and adjusting the phosphoric acid content was used. More specifically, in No. 1 shown in Table 1 below, a phosphoric acid aqueous solution (treatment liquid 1) obtained by diluting the chemical A 10 times with water and adjusting the phosphoric acid amount to 3.0 mass % was used. Also, as Nos. 2-18 shown in Table 1 below, a phosphoric acid aqueous solution (treatment liquid 2-18) prepared by properly diluting the chemical A with water and being mixed with nickel pyrophosphate and/or nickel nitrate was used. The phosphoric acid amount (mass %) contained in the phosphoric acid aqueous solution (treatment liquid 2-18) used and Ni content (mol/L) in the phosphoric acid aqueous solution are shown in Table 1 below.

The pure iron powder 1 kg having passed the sieve was added with the treatment liquid 1-18 by 50 mL, was mixed using a V-type mixer, was thereafter dried for 30 min at 200° C. in the atmospheric air, and the powder with phosphoric acid-based chemical conversion coating was manufactured. The time (min) used for mixing by the V-type mixer is shown in Table 1 below.

The powder with phosphoric acid-based chemical conversion coating obtained was embedded in a resin, the cross section was exposed by cross section polisher working (CP working), 10 or more fields of view were observed under a transmission electron microscope (TEM) of 10,000 or more magnifications, and the maximum thickness (nm) of the phosphoric acid-based chemical conversion coating was measured. The measurement result is shown in Table 1 below.

(b) Also, using an embedded material for surface analysis obtained by embedding 10 pieces or more of the pure iron powder particles passing the sieve in a resin, being polished, and exposing the flat surface of the pure iron powder particles instead of the pure iron powder 1 kg passing the sieve, the treatment liquid 1-18 was added by 50 ml, the mixture was mixed using the V-type mixer and was thereafter dried quickly, and test samples for surface analysis coated with the phosphoric acid-based chemical conversion coating were manufactured. The mixing time of the V-type mixer is same to that of (a) described above.

As a result of observing 10 positions or more of the test samples for surface analysis obtained under the scanning electron microscope (SEM) of 10,000 or more magnifications, in the surface of the phosphoric acid-based chemical conversion coating, the coating thickness sharply reduced compared to the coating thickness of the periphery, and plural numbers of the recessed portions where the coating thickness was 50% or less relative to the coating thickness of the periphery were confirmed.

A photo was taken enhancing contrast on the recessed portions and potions other than the recessed portions, image analysis was performed, and the total area of the openings formed by the recessed portions on the surface of the phosphoric acid-based chemical conversion coating relative to the total area of the field of view was calculated. The result is shown in Table 1 below. Also, because the recessed portions formed on the surface of the phosphoric acid-based chemical conversion coating were formed by that the coating thickness sharply reduced compared to periphery, three-dimensional analysis was not performed, and the area of the recessed portions formed on the surface of the phosphoric acid-based chemical conversion coating was made the area of the opening as it was.

Further, the shape of the recessed portion is shown in Table 1 below. In Table 1 below, "wide range" means the recessed portion in which the circle equivalent diameter of the opening is 5 μm or more, and "pit" means the recessed portion in which the shape of the opening is a generally circular shape.

The shape of the opening formed by the recessed portion on the surface of the phosphoric acid-based chemical conversion coating was a generally circular shape. Ten positions of the openings formed on the surface of the phosphoric acid-based chemical conversion coating were selected optionally, the circle equivalent diameter of the openings was measured, and the average value (average circle equivalent diameter) was obtained. The result is shown in Table 1 below. Also, when the aluminum element amount in the phosphoric acid-based chemical conversion coating was measured, the aluminum element was not detected in any of the phosphoric acid-based chemical conversion coatings.

When the shape of the recessed portion formed on the surface of the phosphoric acid-based chemical conversion coating was a pit shape, the number of pieces of the pits was measured and was converted to that per a field of view of 5

μm×5 μm, and the average value of the number of pieces of the openings was calculated. The calculation result is shown in Table 1 below.

Also, 10 positions or more of the lamination cross section of the phosphoric acid-based chemical conversion coating were observed, the number of pieces of the openings of a generally circular shape per 5 μm of the surface length of the iron-based soft magnetic powder was measured, and the average value was obtained. The calculated result is shown in Table 1 below.

Next, the powder with phosphoric acid-based chemical conversion coating was formed with the silicone resin coating on the surface thereof, was thereafter compressively formed and was subjected to heat treatment, and the powder magnetic core was manufactured.

(Formation and Preliminary Hardening of Silicone Resin Coating)

As the silicone resin solution, a resin solution having resin solid content of 4.8% prepared by dissolving a silicone resin "SR2400" (made by Dow Corning Toray Co., Ltd.) in toluene was used. This resin solution was added to and mixed with the iron powder with phosphoric acid-based chemical conversion coating so that the resin solid content became 0.1%, was heated and dried by an oven furnace in an atmospheric air for 30 min at 75° C., and was thereafter made to pass through a sieve with the opening of 300 μm. Thereafter, preliminary hardening was performed for 30 min at 150° C., and the iron powder with silicone resin coating was manufactured.

(Compressive Forming)

Next, the iron powder with silicone resin coating in which polyhydroxycarboxylic acid amine was added by 0.2% as a lubricant and mixed was put in the die and was compressively formed at the room temperature with the contact pressure of 784 MPa, and a compressed powder body of 31.75 mm×12.7 mm and the height of approximately 5 mm was manufactured.

(Heat Treatment)

Then, the compressed powder core obtained was subjected to heat treatment for 120 min at 400° C. under an air atmosphere, annealing was thereafter performed for 30 min at 550° C. to manufacture the powder magnetic core. The temperature raising rate in heating from 400° C. to 550° C. was made approximately 10° C./min.

With respect to the powder magnetic core obtained by the heat treatment, the lamination cross section of the phosphoric acid-based chemical conversion coating was observed, and the rate of the total of the length of portions where the phosphoric acid-based chemical conversion coating was adhered relative to the total of the surface length of the iron-based soft magnetic powder particles was calculated with respect to the portion surrounded by three pieces or more of the iron-based soft magnetic powder particles. As a result, it was confirmed that all of them was 50% or more by length.

Also, with respect to the powder magnetic core obtained by the heat treatment, the lamination cross section of the phosphoric acid-based chemical conversion coating was observed, the number of pieces of the recessed portions with the opening of 50-1,000 nm width relative to 5 μm surface length of the iron-based soft magnetic powder particle was measured, and the average value thereof was obtained. The calculation result is shown in Table 1 below.

Also, with respect to the powder magnetic core obtained by the heat treatment, whether or not the first oxide layer was formed between the iron-based soft magnetic powder particle and the phosphoric acid-based chemical conversion coating was examined, and, when it was formed, the thickness (nm) thereof was measured. More specifically, the mirror surface of the cross section of the powder magnetic core was exposed by CP working, 10 positions or more of the portion surrounded by three pieces of more of the iron-based soft magnetic powder particles were observed under a SEM with 10,000 or more magnifications, and the maximum thickness (nm) of the first oxide layer observed between the iron-based soft magnetic powder particle and the phosphoric acid-based chemical conversion coating was measured. The measurement result is shown in Table 1 below.

With respect to the powder magnetic core obtained by the heat treatment, whether or not the second oxide layer was formed on the phosphoric acid-based chemical conversion coating or on the silicone resin coating was examined. As a result, with respect to Nos. 3-16 shown in Table 1 below, the second oxide layer was formed in all of them.

Next, with respect to the powder magnetic core obtained by the heat treatment, the specific resistance and the transverse rupture strength were measured according to the procedures described below, and the calculation result was shown in Table 1 below.

[Specific Resistance]

The specific resistance of the powder magnetic core was measured in a 4 terminal resistance measuring mode (4 terminal method) using "RM-14L" made by Rika Denshi, Co., Ltd. as a probe and the digital multimeter "VOAC-7510" made by Iwatsu Test Instruments Corporation as a measurement instrument. The measurement was performed with the distance between the terminals of 7 mm, the stroke length of the probe of 5.9 mm, and the spring load of 10-S type, and with the probe being pressed to the measurement sample. In the present invention, the case the specific resistance is 65 μΩ·m or more is evaluated to have passed.

[Transverse Rupture Strength]

The mechanical strength of the powder magnetic core was evaluated by measuring the transverse rupture strength. The transverse rupture strength was measured by performing the transverse rupture strength test using a plate-like powder magnetic core. The test was performed by a three point bending test according to JPMA M 09-1992 (Japan Powder Metallurgy Association; Method for testing transverse rupture strength of sintered metal material). The transverse rupture strength was measured using a tensile tester ("AUTOGRAPH AG-5000E" made by Shimadzu Corporation) with the distance between support points of 25 mm. In the present invention, the case the transverse rupture strength is 80 MPa or more is evaluated to have passed.

From Table 1 below, following consideration is possible. No. 18 is an example in which the maximum thickness of the phosphoric acid-based chemical conversion coating formed on the surface of the iron-based soft magnetic powder particles is excessively large, and the transverse rupture strength lowered. Also, in the powder magnetic core, the oxide layer was formed between the iron-based soft magnetic powder particle and the phosphoric acid-based chemical conversion coating, the thickness thereof was excessively large, and therefore the transverse rupture strength lowered.

No. 4 is an example in which the maximum thickness of the phosphoric acid-based chemical conversion coating formed on the surface of the iron-based soft magnetic powder particles is excessively small, and the specific resistance lowered. No. 1 and No. 2 are examples in which the area ratio of the recessed portions formed on the surface of the phosphoric acid-based chemical conversion coating is excessively large, the specific resistance was small, and the transverse rupture strength also lowered. No. 17 is an example in which the area ratio of the recessed portions formed on the surface of the phosphoric acid-based chemical conversion coating is excessively small, the specific resistance was small, and the transverse rupture strength also lowered.

On the other hand, in Nos. 3, 5-16, because the maximum thickness of the phosphoric acid-based chemical conversion coating formed on the surface of the iron-based soft magnetic powder and the area ratio of the recessed portions formed on the surface of the phosphoric acid-based chemical conversion coating have been properly controlled, both of high specific resistance and high transverse rupture strength have been achieved. Particularly, in Nos. 6-14, because the shape of the recessed portions is a pit shape and the number density of the pit and the circle equivalent diameter of the pit have been controlled, both of the specific resistance and the transverse rupture strength particularly have been increased.

Next, in FIG. 2, with respect to No. 10 shown in Table 1 below, a photo substituting a drawing obtained by photographing the surface of the phosphoric acid-based chemical conversion coating under a scanning electron microscope (SEM) of 20,000 magnifications is shown. Also, in FIG. 3, with respect to No. 10 shown in Table 1 below, a photo substituting a drawing obtained by photographing the lamination cross section of the phosphoric acid-based chemical conversion coating under a scanning electron microscope (SEM) of 50,000 magnifications is shown. Further, the position where FIG. 3 was photographed corresponds to the portion surrounded by the dotted line in FIG. 1 above, and the cross section including the first oxide layer has been photographed.

Figure 2:
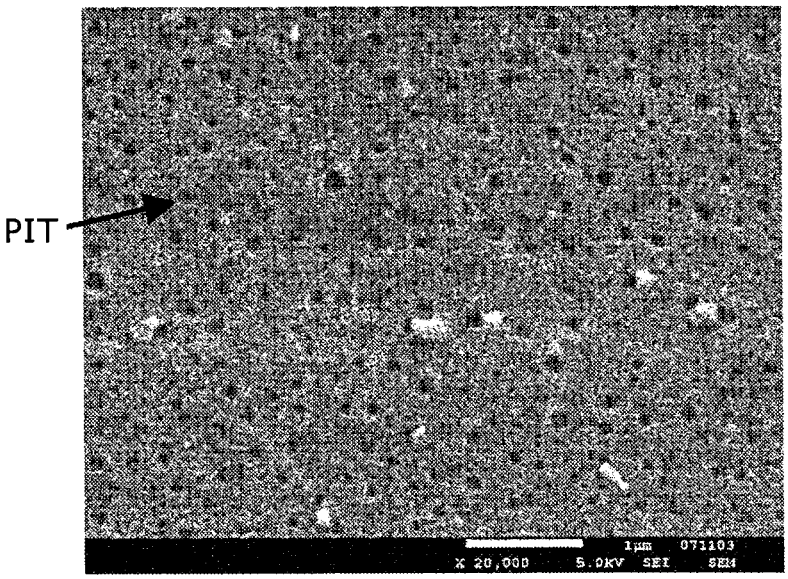
FIG. 2 is a photo substituting a drawing obtained by photographing the surface of the phosphoric acid-based chemical conversion coating under scanning electron microscope (SEM).
Figure 3:
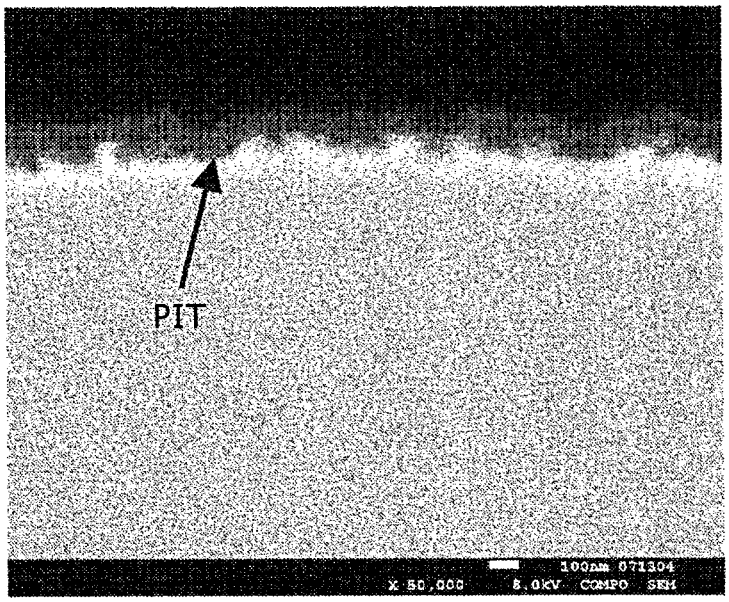
FIG. 3 is a photo substituting a drawing obtained by photographing the lamination cross section of the phosphoric acid-based chemical conversion coating under a scanning electron microscope (SEM).

From FIG. 2 and FIG. 3, it is known that the shape of the recessed portions formed on the surface of the phosphoric acid-based chemical conversion coating becomes a pit shape when Ni is contained in the phosphoric acid-based chemical conversion coating.

Although the present invention has been described in detail referring to specific embodiments, it is obvious for a person skilled in the art that various alterations and amendments can be effected without departing from the spirit and range of the present invention.

The present application is based on Japanese Patent Application (No. 2012-162110) applied on Jul. 20, 2012, and the contents thereof are hereby incorporated by reference.

INDUSTRIAL APPLICABILITY

In the powder for a powder magnetic core of the present invention, because an insulation coating having heat resistance has been formed on the surface thereof, excellent insulation performance is exhibited even when a heat treatment is performed at a high temperature. Therefore, compressive forming at a high temperature can be performed in manufacturing the powder magnetic core, and the powder magnetic core excellent in insulation performance and having high strength is obtained.

The invention claimed is:

1. A powder, comprising iron-based soft magnetic powder particles comprising a phosphoric acid-based chemical conversion coating on a surface thereof, wherein the phosphoric acid-based chemical conversion coating has a non-uniform thickness and recessed portions are formed on a surface of the phosphoric acid-based chemical conversion coating, the phosphoric acid-based chemical conversion coating has a maximum thickness of 20-200 nm, and the recessed portions form openings on the surface of the phosphoric acid-based chemical conversion coating, the openings having a total area of 0.5-50% relative to a total area of field of view when ten or more positions of the surface of the phosphoric acid-based chemical

| | Phosphoric acid-based chemical conversion treatment | | | Phosphoric acid-based chemical conversion coating | | | | | | Powder magnetic core | | | |
|---|---|---|---|---|---|---|---|---|---|---|---|---|---|
| No. | Phosphoric acid (mass %) | Ni (mol/L) | Mixing time (min) | Maximum thickness (nm) | Total area of openings (%) | Shape of recessed portion | Average circle equivalent diameter (nm) | Number of pieces of openings: 5 μm × 5 μm (pieces/25 μm²) | Number of pieces of openings: Surface length 5 μm (pieces/5 μm) | Number of pieces of recessed portion (pieces/5 μm) | Maximum thickness of first oxide layer (nm) | Specific resistance (μΩ · m) | Transverse rupture strength (MPa) |
| 1 | 3.0 | 0 | 30 | 125 | 86.5 | Wide range | — | — | — | — | — | 36 | 71 |
| 2 | 3.5 | 0.001 | 45 | 188 | 52.0 | Wide range | — | — | — | — | — | 60 | 73 |
| 3 | 3.5 | 0.001 | 30 | 104 | 45.7 | Wide range | — | — | — | — | 27 | 66 | 100 |
| 4 | 1.0 | 0.01 | 45 | 14 | 45.6 | Pit | 984 | 15 | 3 | 3 | 15 | 24 | 105 |
| 5 | 1.5 | 0.01 | 45 | 25 | 48.1 | Pit | 1180 | 11 | 1 | 1 | 48 | 65 | 106 |
| 6 | 0.5 | 0.02 | 45 | 22 | 31.0 | Pit | 839 | 14 | 4 | 4 | 27 | 77 | 102 |
| 7 | 2.5 | 0.07 | 15 | 28 | 40.4 | Pit | 370 | 94 | 11 | 9 | 35 | 84 | 104 |
| 8 | 2.0 | 0.02 | 20 | 35 | 2.8 | Pit | 273 | 12 | 1 | 1 | 42 | 96 | 106 |
| 9 | 2.0 | 0.04 | 45 | 84 | 9.4 | Pit | 240 | 52 | 9 | 8 | 9 | 115 | 113 |
| 10 | 2.0 | 0.10 | 30 | 67 | 9.1 | Pit | 166 | 105 | 12 | 11 | 0 | 164 | 123 |
| 11 | 3.0 | 0.12 | 10 | 35 | 6.3 | Pit | 105 | 183 | 15 | 14 | 0 | 155 | 125 |
| 12 | 3.5 | 0.15 | 30 | 91 | 4.5 | Pit | 86 | 193 | 16 | 13 | 6 | 116 | 113 |
| 13 | 3.0 | 0.08 | 45 | 124 | 3.0 | Pit | 99 | 98 | 10 | 8 | 115 | 107 | 97 |
| 14 | 3.5 | 0.08 | 60 | 188 | 1.1 | Pit | 61 | 95 | 10 | 7 | 131 | 85 | 94 |
| 15 | 0.5 | 0.04 | 180 | 113 | 2.0 | Pit | 280 | 8 | <1 | <1 | 192 | 68 | 83 |
| 16 | 4.5 | 0.07 | 30 | 144 | 0.6 | Pit | 49 | 74 | 9 | 8 | 174 | 69 | 81 |
| 17 | 4.0 | 0.05 | 45 | 186 | 0.2 | Pit | 56 | 16 | 5 | 5 | 222 | 64 | 61 |
| 18 | 4.0 | 0.12 | 60 | 209 | 0.5 | Pit | 66 | 35 | 7 | 6 | 253 | 83 | 46 |

conversion coating are observed under a scanning electron microscope of 10,000 or more magnifications.

2. The powder according to claim 1, wherein the openings are of a generally circular shape having an average circle equivalent diameter of 50-1,000 nm; and when 10 or more positions of a region of 5 μm×5 μm on the surface of the phosphoric acid-based chemical conversion coating are observed, a number of the openings is 10 or more on average, or when 10 or more positions of a cross section of the phosphoric acid-based chemical conversion coating are observed, a number of the openings is one or more on average per 5 μm surface length of the iron-based soft magnetic powder particles.

3. A powder magnetic core, obtained by a process comprising compressively forming a powder, which comprises iron-based soft magnetic powder particles having a phosphoric acid-based chemical conversion coating on a surface thereof, wherein the phosphoric acid-based chemical conversion coating has a non-uniform thickness and recessed portions are formed on a surface of the phosphoric acid-based chemical conversion coating, when a broken-out section of the powder magnetic core is observed, in a portion surrounded by three or more of the iron-based soft magnetic powder particles:

the phosphoric acid-based chemical conversion coating has a maximum thickness of 20-200 nm;

the recessed portions form openings on the surface of the phosphoric acid-based chemical conversion coating; and a total length of surface of the three or more iron-based soft magnetic powder particles where the phosphoric acid-based chemical conversion coating is adhered is 50% or more relative to a total length of the surface of the three or more iron-based soft magnetic powder particles; and in the portion surrounded by three or more of the iron-based soft magnetic powder particles:

one or more on average recessed portions comprising 50-1,000 nm-wide openings are present per 5 μm length of the surface of the iron-based soft magnetic powder particles in the phosphoric acid-based chemical conversion coating;

a first oxide layer, the phosphoric acid-based chemical conversion coating, and a second oxide layer are laminated in this order on the surface of the iron-based soft magnetic powder particles where the phosphoric acid-based chemical conversion coating is adhered; and a thickness of the first oxide layer is 200 nm or less.

4. The powder according to claim 1, wherein the phosphoric acid-based chemical conversion coating contains Ni.

5. The powder according to claim 1, further comprising a silicone resin coating on the phosphoric acid-based chemical conversion coating.

6. The powder magnetic core according to claim 3, wherein the phosphoric acid-based chemical conversion coating contains Ni.

7. The powder according to claim 5, wherein the silicon resin coating has a thickness of 1-200 nm.

8. A powder magnetic core, obtained by a process comprising compressively forming the powder according to claim 1.

9. The powder magnetic core according to claim 3, wherein the powder further comprises a silicone resin coating on the phosphoric acid-based chemical conversion coating.

10. The powder according to claim 1, wherein the recessed portions are portions of the phosphoric acid-based chemical conversion coating having a thickness which is 50% or less of the maximum thickness of the phosphoric acid-based chemical conversion coating.

11. The powder according to claim 5, wherein a total thickness of the phosphoric acid-based chemical conversion coating and the silicon resin coating is 250 nm or less.

12. The powder magnetic core according to claim 3, wherein the recessed portions are portions of the phosphoric acid-based chemical conversion coating having a thickness which is 50% or less of the maximum thickness of the phosphoric acid-based chemical conversion coating.

13. The powder magnetic core according to claim 9, wherein the silicon resin coating has a thickness of 1-200 nm.

14. The powder magnetic core according to claim 9, wherein a total thickness of the phosphoric acid-based chemical conversion coating and the silicon resin coating is 250 nm or less.

* * * * *